US006145827A

United States Patent [19]

Harada et al.

[11] Patent Number: 6,145,827

[45] Date of Patent: Nov. 14, 2000

[54] AUTOMATIC DOCUMENT CONVEYER

[75] Inventors: Hiroyuki Harada; Masuo Kawamoto; Masahiro Sako; Shigeo Kurando, all of Osaka; Takatomo Fukumoto, Nagano-ken, all of Japan

[73] Assignee: Kyocera Mita Corporation, Osaka, Japan

[21] Appl. No.: 09/352,143

[22] Filed: Jul. 13, 1999

[30] Foreign Application Priority Data

Jul. 13, 1998 [JP] Japan ..... 10-196842

[51] Int. Cl.[7] ..... B65H 5/22

[52] U.S. Cl. ..... 271/3.01; 271/4.01; 271/6; 271/7; 271/10.01

[58] Field of Search ..... 271/3.01, 3.05, 271/3.08, 3.14, 4.01, 6, 7, 10.01, 10.07, 10.1; 399/367

[56] References Cited

U.S. PATENT DOCUMENTS 5,363,184 11/1994 Matsuo et sl. ..... 271/7 X 5,470,051 11/1995 Morigami et al. ..... 271/7

*Primary Examiner*—David H. Bollinger

*Attorney, Agent, or Firm*—Antonelli, Terry, Stout & Kraus, LLP

[57] ABSTRACT

An automatic document conveyer comprising a moving frame turnably mounted on a machine housing via a hinge mechanism and a conveyer belt mechanism mounted on the moving frame. The conveyer belt mechanism includes a support frame, a drive roller and a driven roller arranged in the support frame, and a conveyer belt wrapped round the drive roller and the driven roller. The support frame of the conveyer belt mechanism is so supported as to be moved by a predetermined amount toward the side opposite to the hinge mechanism while the end of the conveyer belt on the side of the hinge mechanism reaches to the closed position after having come in contact with the transparent plate at the time when the moving frame is turned toward the closed position.

6 Claims, 7 Drawing Sheets

AUTOMATIC DOCUMENT CONVEYER

FIELD OF THE INVENTION

The present invention relates to an automatic document conveyer employed by document processors such as electrostatic copier, facsimile, image reader and the like.

DESCRIPTION OF THE PRIOR ART

With a recent trend toward carrying out the copying processing of a copier at a high speed and automatically, there is practically used an automatic document conveyer which successively and automatically feeds plural pieces of documents to a document set position on the upper surface of a transparent plate. Such an automatic document conveyer which successively and automatically feeds plural pieces of documents is widely used in the document processors such as facsimiles and document readers, too. The automatic document conveyer of this type includes a moving frame that is arranged to move between a closed position where it covers a transparent plate arranged on the upper surface of a machine housing and an open position where it permits the transparent plate to be exposed, and a conveyer belt mechanism which conveys the document along the document conveying passage formed on the transparent plate when the moving frame is brought to the closed position. The conveyer belt mechanism includes a support frame, a drive roller and a driven roller arranged in the support frame, apart from each other, in parallel in the direction of conveyance, and an endless conveyer belt wrapped round the drive roller and the driven roller. The moving frame is turnably mounted on the upper surface of the machine housing via a hinge mechanism, and the conveyer belt mechanism is mounted on the moving frame. The thus constituted automatic document conveyer is considerably heavy and requires a considerably large operation force for turning it from the closed position to the open position. To reduce this force, there has generally been employed a so-called lift-type hinge mechanism equipped with a spring member that exerts force for lifting the moving frame toward the opening direction at all times.

In the automatic document conveyer equipped with the above-mentioned lift-type hinge mechanism, however, the moving frame is pushed toward the open position by utilizing the repulsive force of the spring and, hence, the fulcrum of the hinge is inevitably located at a position higher than the upper surface of the machine housing, i.e., higher than the upper surface of the transparent plate. When the fulcrum of the hinge or the fulcrum of turn of the moving frame locates at a position higher than the upper surface of the transparent plate, the position of contact with the transparent plate is displaced toward the side of the hinge mechanism while the conveyer belt of the conveyer belt mechanism mounted on the moving frame turns up to the closed position after it has come in contact with the transparent plate. When the automatic document conveyer is opened and the document is set by hand on the transparent plate, therefore, the document is shifted toward the side of the hinge mechanism when the automatic document conveyer is brought to the closed position; i.e., the document is deviated from the position at which it was set. In a copier of the type in which the document is set with its edge at one end to be brought in contact with the document instruction plate disposed on the side of the hinge mechanism (rear side), therefore, this deviation causes the document to be deflected and floated, producing a band-like shade on the image.

SUMMARY OF THE INVENTION

The object of the present invention is to provide an automatic document conveyer that prevents the position of the document from being deviated when the document is set by hand on the transparent plate.

In order to accomplish the above-mentioned object according to the present invention, there is provided an automatic document conveyer comprising a moving frame arranged to move between a closed position where it covers a transparent plate arranged on the upper surface of a machine housing and an open position where it permits the transparent plate to be exposed, and a conveyer belt mechanism which conveys the document when said moving frame is brought to the closed position, said moving frame being turnably mounted on said machine housing via a hinge mechanism; wherein said conveyer belt mechanism includes a support frame, a drive roller and a driven roller arranged apart from each other in said support frame in parallel in the direction of conveying the document, and a conveyer belt wrapped round said drive roller and said driven roller, said conveyer belt mechanism being supported on said moving frame by a first support means that supports said support frame on the side of said hinge mechanism and by a second support means that supports said support frame at an end on the side opposite to said hinge mechanism;

said first support means moves said conveyer belt mechanism by a predetermined amount toward the side opposite to said hinge mechanism while the end of said conveyer belt on the side of said hinge mechanism reaches to said closed position after having come in contact with said transparent plate, at the time when said moving frame is turned toward said closed position; and said second support means permits the motion of said conveyer belt mechanism.

The first support means includes first support members mounted on said support frame and having pin-insertion holes, second support members mounted on said moving frame and having guide holes, and support pins arranged by being inserted in the pin-insertion holes of the first support members and in the guide holes in the second support members, the guide holes having a shape elongated in the up-and-down direction and being inclined toward the side opposite to the hinge mechanism from the lower side toward the upper side.

The second support means supports the support frame on the moving frame, with a predetermined amount of suspension so as to allow the conveyer belt to come in contact with the transparent plate in parallel therewith when the moving frame is turned toward the closed position.

Other features of the present invention will become obvious from the following description.

DETAILED DESCRIPTION OF THE PREFERRED EMBODIMENTS

Preferred embodiments of the automatic document conveyer constituted according to the present invention will now be described in detail with reference to the accompanying drawings.

Figure 1:
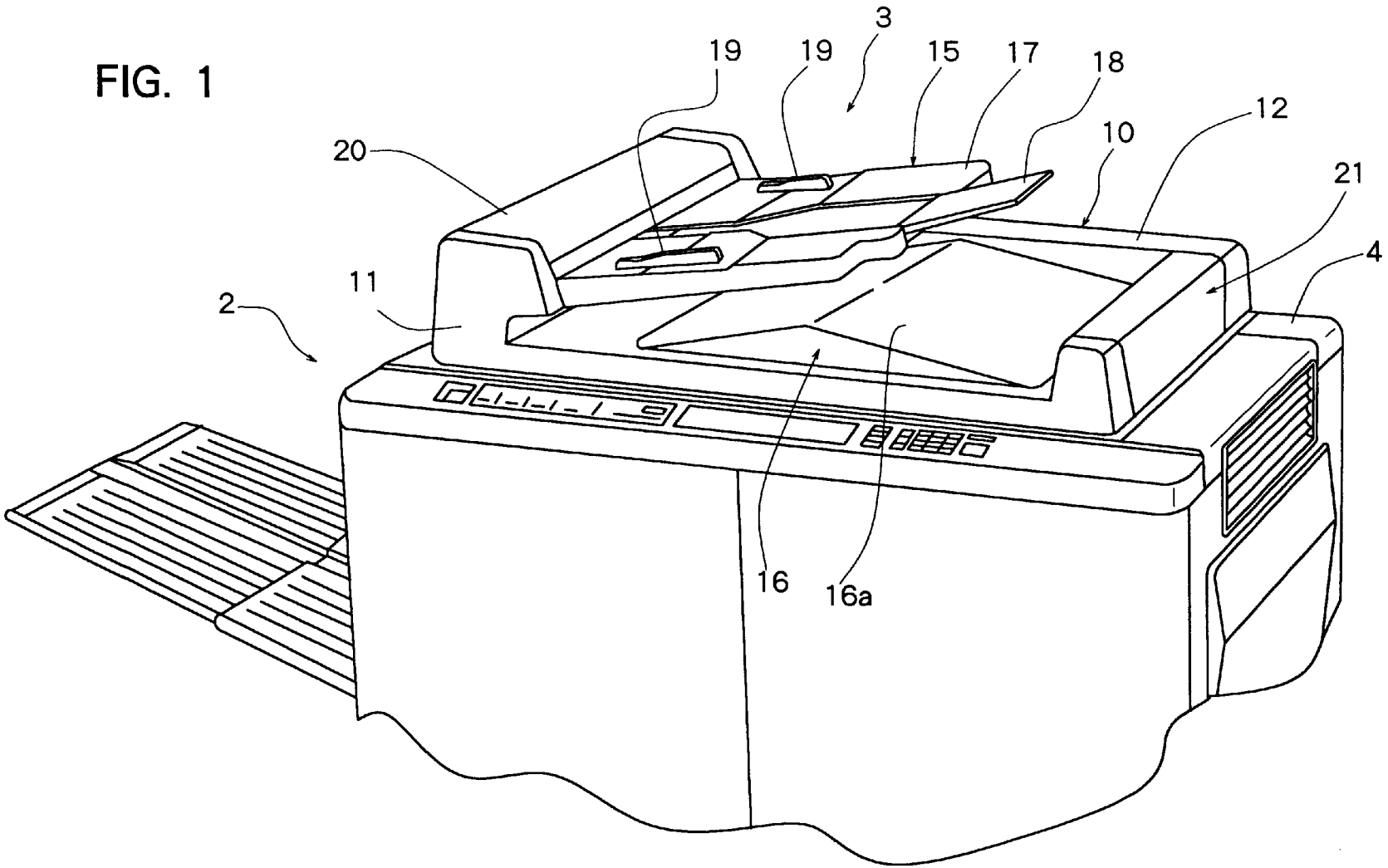
FIG. 1 is a perspective view illustrating a state where an automatic document conveyer constituted according to a preferred embodiment of the present invention is mounted on an electrostatic copier.
Figure 2:
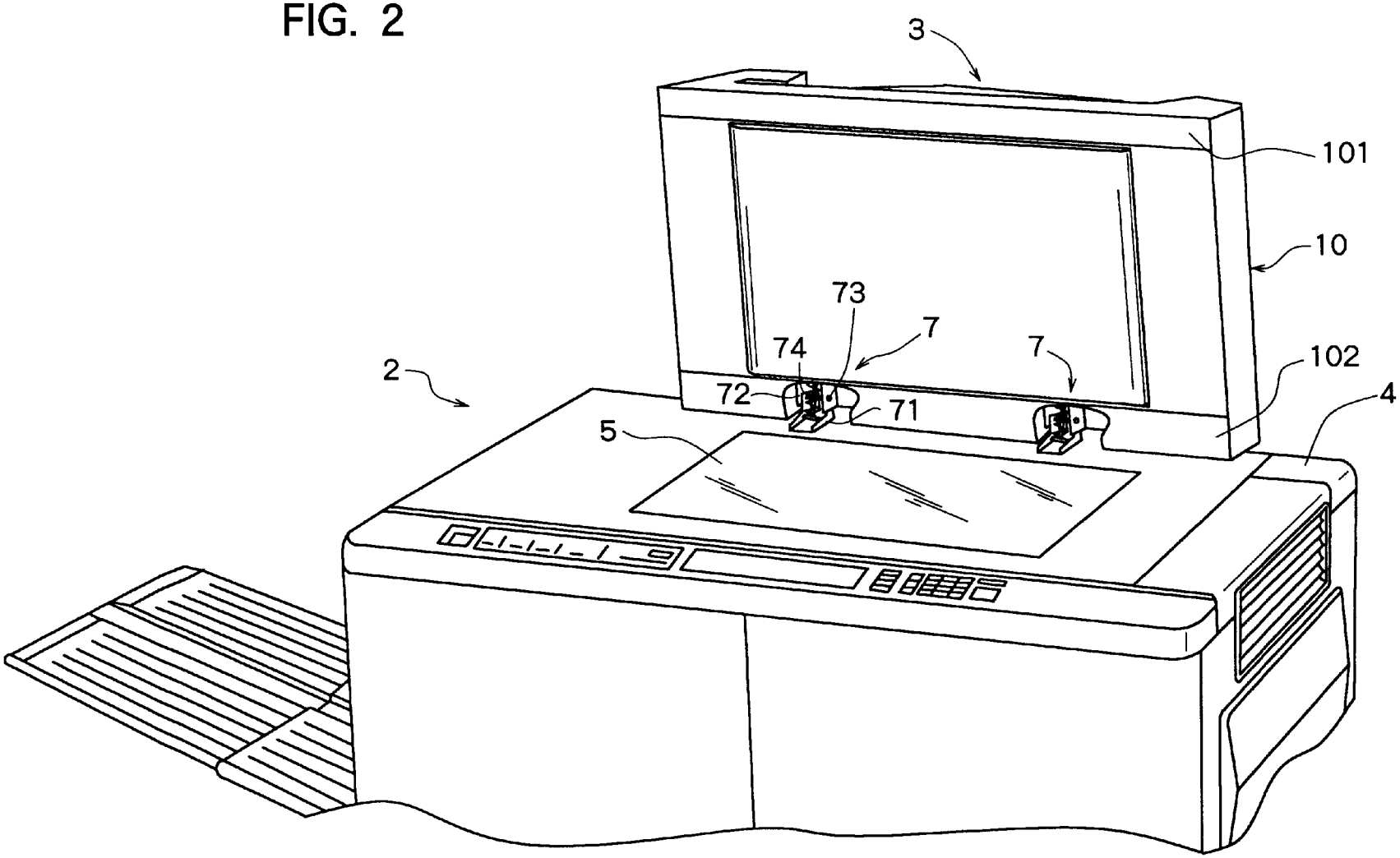
FIG. 2 is a perspective view illustrating a state where the automatic document conveyer shown in FIG. 1 is brought to an open position.
Figure 3:
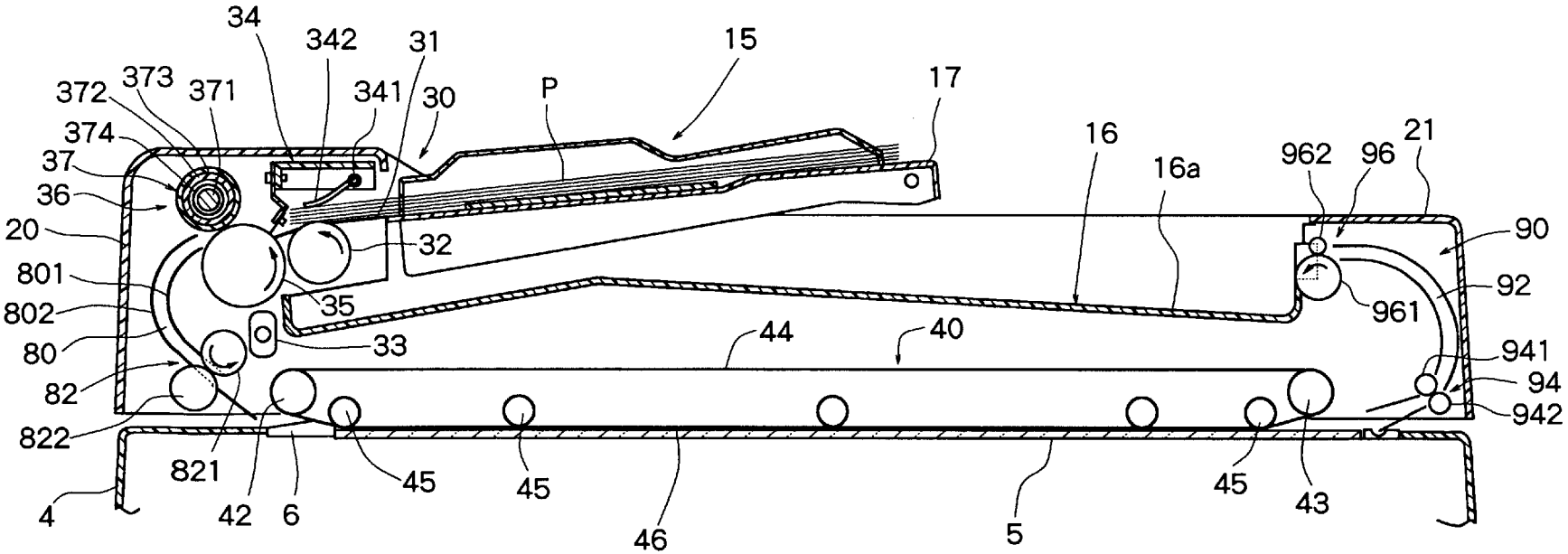
FIG. 3 is a sectional view schematically illustrating the automatic document conveyer shown in FIG. 1.

FIGS. 1, 2 and 3 illustrate an upper end portion of an electrostatic copier 2 and an automatic document conveyer 3 mounted thereon. The electrostatic copier 2 has a housing 4. A transparent plate 5 which may be a glass plate is mounted on the upper surface of the housing 4. A document restriction member 6 is disposed on one side of the transparent plate 5 (left side in FIG. 3) to determine a reference position for setting the document. The automatic document conveyer 3 constituted according to the present invention is turnably mounted at the rear end on the upper surface of the housing 4 of the electrostatic copier 2 by means of two hinge mechanisms 7 (see FIG. 2). The hinge mechanism 7 comprises a first support member 71 mounted on the housing 4, a second support member 72 mounted on a moving frame 10 of the automatic document conveyer 3, a hinge pin 73 rotatably coupling the first support member 71 and the second support member 72 together, and a compression coil spring 74 interposed between the first support member 71 and the second support member 72 to urge them toward the direction in which they are opened. The automatic document conveyer 3 is turnably mounted on the housing 4 by the thus constituted two hinge mechanisms 7, and is turned on the hinge pins 73 of the hinge mechanisms 7 as a center between a closed position shown in FIGS. 1 and 3 and an open position shown in FIG. 2, the hinge pines 73 extending along the rear side edge of the transparent plate 5. To set a document by hand on the transparent plate 5 of the electrostatic copier 2, the automatic document conveyer 3 is brought to the open position shown in FIG. 2 to expose the transparent plate 5, the document is placed on a required position on the transparent plate 5, and the automatic document conveyer 3 is brought to the closed position to cover the transparent plate 5 and the document placed thereon. On the other hand, in the case where the document is automatically introduced onto the transparent plate 5 and is automatically discharged from the transparent plate 5 by using the automatic document conveyer 3, the automatic document conveyer 3 is brought to the closed position.

If further described with reference to FIGS. 1 to 3, the illustrated automatic document conveyer 3 includes a front cover 11 and a rear cover 12 arranged at a distance in the back-and-forth direction (direction perpendicular to the surface of the paper in FIG. 3). The front cover 11 and the rear cover 12 can be formed of a suitable synthetic resin. The front cover 11 and the rear cover 12 are respectively mounted on a front support base plate 101 and on a rear support base plate 102 that constitute the moving frame 10. The front support base plate 101 and the rear support base plate 102 are formed of a steel plate. Various constituent elements of the automatic document conveyer 3 are directly or indirectly supported by the front support base plate 101 and the rear support base plate 102. A document-placing means 15 and a document discharge tray 16 are arranged between the front cover 11 and the rear cover 12. The document-placing means 15 includes a document table 17 that extends being inclined upward from a front end on the left side toward the rear end on the right side in FIG. 3, and an auxiliary table 18 swingably mounted on the rear end of the document table 17. A pair of width restriction members 19 are mounted on the document table 17 so as to freely move in the direction of width. The pair of width restriction members 19 are coupled together under the document table 17 via a rack-and-pinion mechanism (not shown) that has been known per se., and are allowed to move, in an interlocking manner, in a direction in which they approach each other and in a direction in which they separate away from each other. The document discharge tray 16 is disposed under the document-mounting means 15, and has a document-placing surface 16*a* formed in the shape of a mountain as viewed from the back-and-forth direction (direction perpendicular to the surface of the paper in FIG. 3). A left end cover 20 is disposed between a left end of the front cover 11 and a left end of the rear cover 12, and a right end cover 21 is disposed between the right ends of these covers.

If further described with reference to FIG. 3, a forward feed means 30 is disposed on the downstream side of the document table 17 in the direction of conveyance. The forward feed means 30 has a guide plate 31 extending toward the downstream side of the document table 17 in the direction of conveyance. An opening is formed in the guide plate 31 on its downstream side, and a forward feed roller 32 constituting the forward feed means 30 is disposed under the opening. The forward feed roller 32 is formed of an elastic material having a high coefficient of friction such as urethane rubber or the like, and is so disposed that the outer peripheral surface thereof partly protrude upward to a slight degree beyond the opening formed in the guide plate 31. A rotary shaft (not shown) of the forward feed roller 32 is drivably coupled to an electric motor 33 which is a drive source, via a drive power transmission mechanism that is not shown.

A forward feed pressing mechanism 34 that constitutes the forward feed means 30 is disposed above the forward feed roller 32. The forward feed pressing mechanism 34 includes a rotary shaft 341 arranged above the forward feed roller 32 in parallel with the forward feed roller 32, and a pressing plate 342 that is secured at its upper end to the rotary shaft 341 and acts at its lower end on the documents (P) placed on the document table 17 and introduced onto the guide plate 31. In the illustrated embodiment, the pressing plate 342 is formed of a thin stainless steel plate having resiliency, fastened at its upper end to the rotary shaft 341 by a fastening means such as screw, and is so constituted as to be brought to an acting position where the lower end thereof acts on the upper surface of the uppermost one of the documents stacked on the document table 17 at a position above the feed roller 32 to push down the documents, and to a non-acting position where the lower end thereof is separated away from the document.

A paper feed roller 35 is disposed on the downstream side of the forward feed means 30. The paper feed roller 35 is formed of a material having a high coefficient of friction such as urethane rubber or the like, and its rotary shaft is drivably coupled to the electric motor 33 which is the drive source, via a drive power transmission mechanism that is not shown. The paper feed roller 35 is so disposed that the outer peripheral surface thereof partly protrudes upward to a slight degree beyond the opening formed in the guide plate 31.

A document separation mechanism 36 is disposed above the paper feed roller 35. In the illustrated embodiment, the document separation mechanism 36 is a separation roller 37 which is constituted by a fixed shaft 371, a cylindrical portion 372 that is formed of a suitable synthetic resin and is arranged about the fixed shaft 371 so as to freely rotate, a surface layer portion 373 that is formed of an elastic material having a high coefficient of friction such as urethane rubber or the like and is fitted onto the outer peripheral surface of the cylindrical portion 372, and a torque limiter mechanism 374 arranged between the fixed shaft 371 and the cylindrical portion 372. The surface layer portion 373 is arranged in contact with the outer peripheral surface of the paper feed roller 35. The torque limiter mechanism 374 is constituted by a clutch mechanism which fixes the cylindrical portion 372 to the fixed shaft 371 when a drive torque larger than a predetermined value acts upon the cylindrical portion 372. The separation roller 37 equipped with the torque limiter mechanism 374 does not constitute a novel feature in the automatic document conveyer constituted according to the present invention, and may be constituted in a manner known per se. Therefore, its details are not described in this specification.

A conveyer belt mechanism 40 is arranged under the document-placing means 15. The conveyer belt mechanism 40 includes a support frame 41, a drive roller 42 and a driven roller 43 arranged in the support frame 41 in parallel with each other at a distance in the direction of conveyance, an endless conveyer belt 44 wrapped round the drive roller 42, driven roller 43 and support frame 41, and a plurality of pushing rollers 45 disposed between the drive roller 42 and the driven roller 43. The lower running side of the conveyer belt 44 extends along the transparent plate 5 of the electrostatic copier 2 thereby to define a document conveying passage 46 between them. The mechanism for supporting the conveyer belt mechanism 40 will be described later in detail.

A document introduction passage 80 is formed between the document conveying passage 46 and the paper feed roller 35. The document introduction passage 80 is defined by an inner guide plate 801 and an outer guide plate 802. A pair of resist rollers 82 are arranged in the document introduction passage 80. The pair of resist rollers 82 include a drive roller 821 and a driven roller 822. The drive roller 821 of the pair of resist rollers 82 is drivably coupled to an electric motor that is not shown, via a suitable drive power transmission mechanism.

In FIG. 3, a document discharge means 90 is arranged on the right side of the document conveying passage 46. The document discharge means 90 includes a document discharge passage 92, a pair of conveyer rollers 92 arranged in the document discharge passage 92, and a pair of discharge rollers 96 disposed at an end of the document discharge passage 92 on the discharge side. The pair of conveyer rollers 94 include a drive roller 941 and a driven roller 942, and the pair of discharge rollers 96 include a drive roller 961 and a driven roller 962. The drive roller 941 of the pair of conveyer rollers 94 and the drive roller 961 of the pair of discharge rollers 96 are drivably coupled to an electric motor that is not shown, via a suitable drive power transmission mechanism.

Next, described below is the operation of the illustrated automatic document conveyer 3.

To carry out the copying operation, the operator, first, places documents P to be copied on the document table 17, and inserts them forward so that the leading end thereof is positioned on the upper side of the forward feed roller 32. When the operator then depresses a copy start key, a solenoid (not shown) of the forward feed pressing mechanism 34 is energized to bring the pressing plate 342 to the acting position and push the documents P placed on the guide plate 31. Concurrently with pushing of the pressing plate 342 onto the documents P, the electric motor 33 is driven, so that the forward feed roller 32 and the paper feed roller 35 are rotated in the directions indicated by arrows in FIG. 3. As the forward feed roller 32 is rotated in the direction indicated by an arrow in FIG. 3, the document is delivered due to the frictional conveying force produced at a contact portion between the outer peripheral surface of the forward feed roller 32 and the lower surface of the document at the lowest position in the stack of documents placed on the guide plate 31.

When the plural pieces of documents are delivered by the forward feed roller 32 as described above, the document of the lowest position only is separated as it passes through between the paper feed roller 35 and the separation roller 37 of the document separation mechanism 36, and is conveyed into the document introduction passage 80. Then, the leading end of the document conveyed into the document introduction passage 80 is brought into contact with the nipping portion of the pair of resist rollers 82 that is in a non-acting state, whereby the primary paper feeding is ended.

After the end of the primary paper feeding as described above, the pair of resist rollers 82 and the conveyer belt mechanism 40 are actuated, and the trailing edge of the document that is primarily fed is brought to a reference position for setting the document on the transparent plate 5. Then, the exposure operation is carried out.

After the end of the exposure operation, the conveyer belt mechanism 40, the pair of conveyer rollers 94 and the pair of discharge rollers 96 of the document discharge means 90 are actuated, so that the document for which the exposure has been effected on the transparent plate 8 is discharged onto the document-placing surface 16*a* of the document discharge tray 16 passing through the document discharge passage 92.

Next, described below with reference to FIGS. 4 to 10 are the support frame 41 for supporting the conveyer belt mechanism 40 and the support means for mounting the support frame 41 on the front support base plate 101 and on the rear support base plate 102. The support frame 41 includes a front plate 411 and a rear plate 412 arranged in parallel at a predetermine distance, and coupling plates 413 and 413 for coupling the front plate 411 and the rear plate 412 together. The rotary shaft 421 of the drive roller 42 is rotatably supported by an end of the front plate 411 (left end in FIG. 4) and by an end of the rear plate 412, which constitute the support frame 41. A pulley 47 is fitted to an end of the rotary shaft 421 on the side of the rear plate 412, the pulley 47 being drivably coupled to a drive source via a drive power transmission mechanism that is not shown. Furthermore, the rotary shaft 431 of the driven roller 43 is rotatably supported by the other end of the front plate 411 (right end in FIG. 4) and by the other end of the rear plate 412, which constitute the support frame 41. The thus constituted support frame 41 has the rear plate 412 supported by the rear support base plate 102 via the first support means 50, 50, and has the front plate 411 supported by the front support base plate 101 via the second support means 60, 60.

Figure 4:
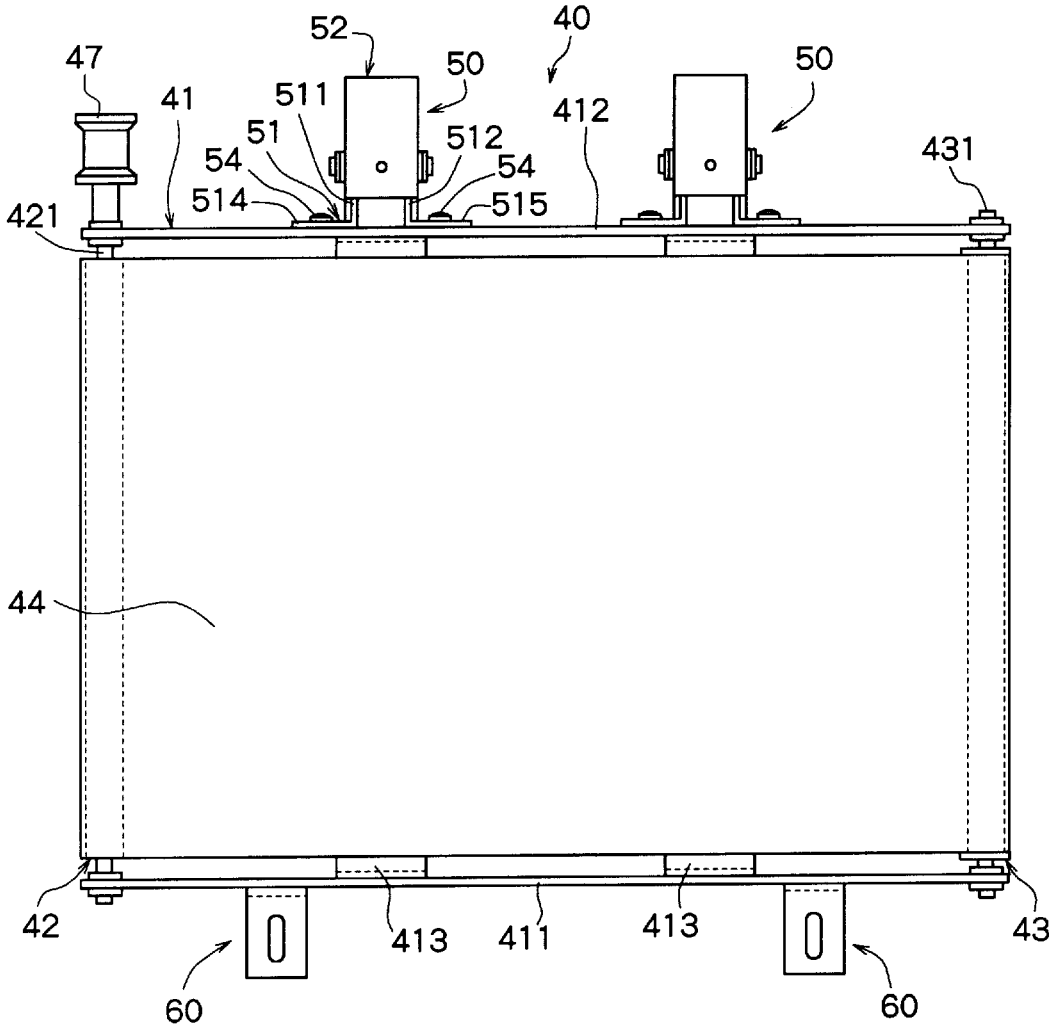
FIG. 4 is a plan view of a conveyer belt mechanism employed by the automatic document conveyer shown in FIGS. 1 and 2.

The first support means 50 will now be described with reference to FIGS. 4 to 6.

The first support means 50 includes a first support member 51 to be mounted on the rear plate 412 of the support frame 41, and a second support member 52 to be mounted on the rear support base plate 102. The first support member 51 includes side walls 511 and 512 extending in parallel at a predetermined distance, a coupling wall 513 for coupling the ends of the side walls 511 and 512 together, support walls 514 and 515 extending outward from the other ends of the side walls 511 and 512, and a stopper 516 that is bent outward from the upper end of the coupling wall 513, which are formed by bending a steel plate member. Pin-insertion holes 517 are formed in the thus formed side walls 511 and 512 of the first support member 51, and support pins 53 are inserted in the pin-insertion holes 517. Mounting holes (not shown) are formed in the support walls 514 and 515, and the support walls 514 and 515 are secured to the rear plate 412 of the support frame 41 by screws 54, 54 inserted in the mounting holes.

The second support member 52 includes side walls 521 and 522 extending in parallel at a predetermined distance, an upper wall 523 coupling the upper ends of the side walls 521 and 522, and a support wall 524 formed by bending an end of the side wall 521 downward. The distance between the inner surfaces of the side walls 521 and 522 corresponds to the length between the outer surfaces of the side walls 511 and 512 of the first support member 51. Guide holes 527 and 527 are formed in the side walls 521 and 522, the guide holes 527 and 527 being elongated in the up-and-down direction. The guide holes 527 and 527 are formed being inclined forward (toward the left in FIGS. 5 and 6) from the lower side toward the upper side. That is, the guide holes 527 and 527 are inclined toward the side opposite to the hinge mechanism 7 from the lower side to the upper side. The thus constituted second support member 52 is turnably coupled to the first support member 51 by fitting the side walls 521 and 522 to the outer sides of the side walls 511 and 512 of the first support member 51 from the upper side, and then inserting the support pins 53 in the guide holes 527 and 527. A pushing means 55 is disposed between the support pin 53 and the upper wall 523 of the second support member 52. The pushing means 55 comprises a pushing member 551 fitted to the support pin 53 from the upper side, and a coil spring 552 disposed between the pushing member 55 and the upper wall 523 of the second support member 52. Therefore, the urging force of the coil spring 552 acts on the support pin 53 via the pushing member 551, and the support pin 53 is pushed toward the lower ends of the guide holes 527 and 527. The thus constituted second support member 52 is secured at its support wall 524 to the rear support base plate 102 by screws 57.

Figure 7:
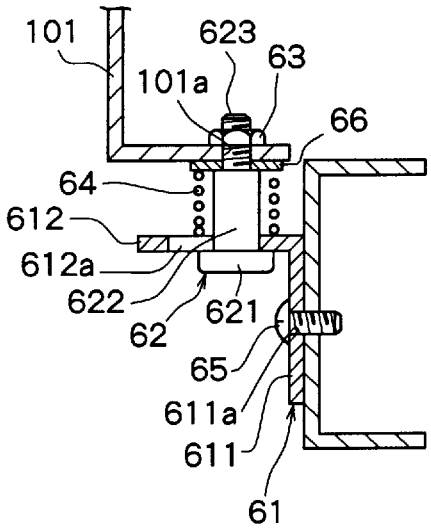
FIG. 7 is a sectional view illustrating a state of mounting a second support means for supporting the conveyer belt mechanism shown in FIG. 4 on the moving frame.

Next, the second support means 60 for supporting the front plate 411 of the support frame 41 on the front support base plate 101 will be described with reference to FIGS. 4 and 7.

The second support means 60 includes a mounting plate 61, a mounting bolt 62 and a nut 63. The mounting plate 61 is formed of a steel plate of an L-shape, and has a mounting portion 611 which is a vertical portion and a support portion 612 which is a horizontal portion. A mounting hole 611*a* is formed in the mounting portion 611. The mounting portion 611 is mounted on the front surface of the front plate 411 that constitutes the support frame 41, by a screw 65 that is inserted in the mounting hole 611*a*. The support portion 612 has a hole 612*a* that is elongated in the, back-and-forth direction (in the up-and-down direction in FIG. 4, or in the right-and-left direction in FIG. 7). The thus constituted mounting plates 61 are attached in a number of two to the front surface of the front plate 411 that constitutes the support frame 41. The mounting bolt 62 is a stepped bolt having a head portion 621, a shaft portion 622 and a threaded portion 623. The mounting bolt 62 is inserted in the elongated hole 612*a* formed in the support portion 612 of the mounting plate 61 from the lower side, the threaded portion 623 is inserted in the hole 101*a* formed in the front support base plate 101 with a washer 66 sandwiched therebetween, and a nut 63 is fitted thereto to support the mounting plate 61. Therefore, the support frame 41 or the conveyer belt mechanism 40 is allowed to move back and forth (in the up-and-down direction in FIG. 4 or in the right-and-left direction in FIG. 7) with respect to the front support base plate 101 along the elongated hole 612*a*, and is further allowed to move up and down (in the direction perpendicular to the surface of the paper in FIG. 4 or in the up-and-down direction in FIG. 7) along the shaft portion 622 of the mounting bolt 62. A coil spring 64 is disposed between the washer 66 fitted to the lower surface of the front support base plate 101 and the support portion 612 of the mounting plate 61, and pushes the support portion 612 toward a direction to separate away from the front support base plate 101 (downward in FIG. 7).

Figure 5:
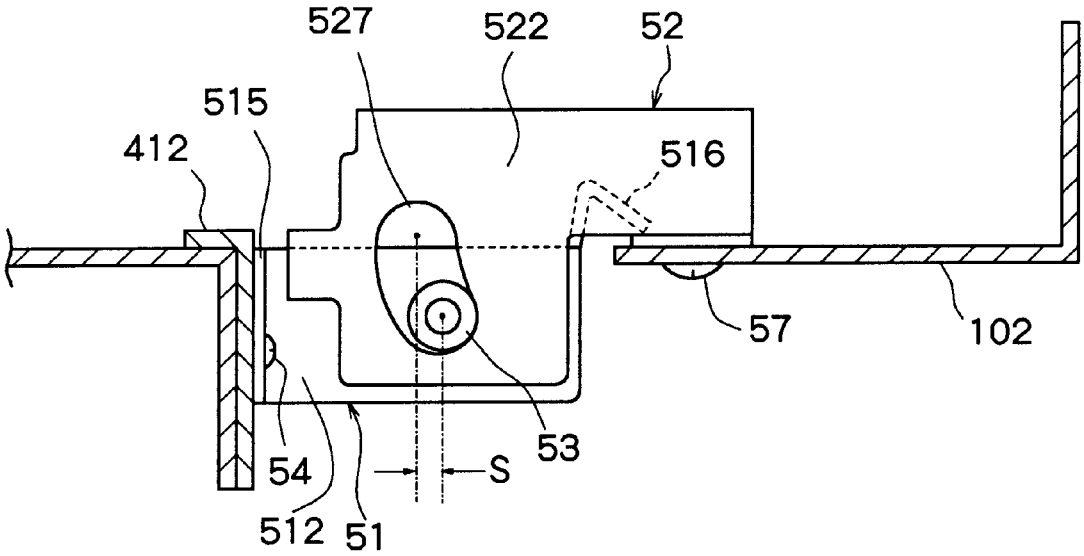
FIG. 5 is a front view illustrating a state of mounting a first support means for supporting the conveyer belt mechanism shown in FIG. 4 on a moving frame.
Figure 6:
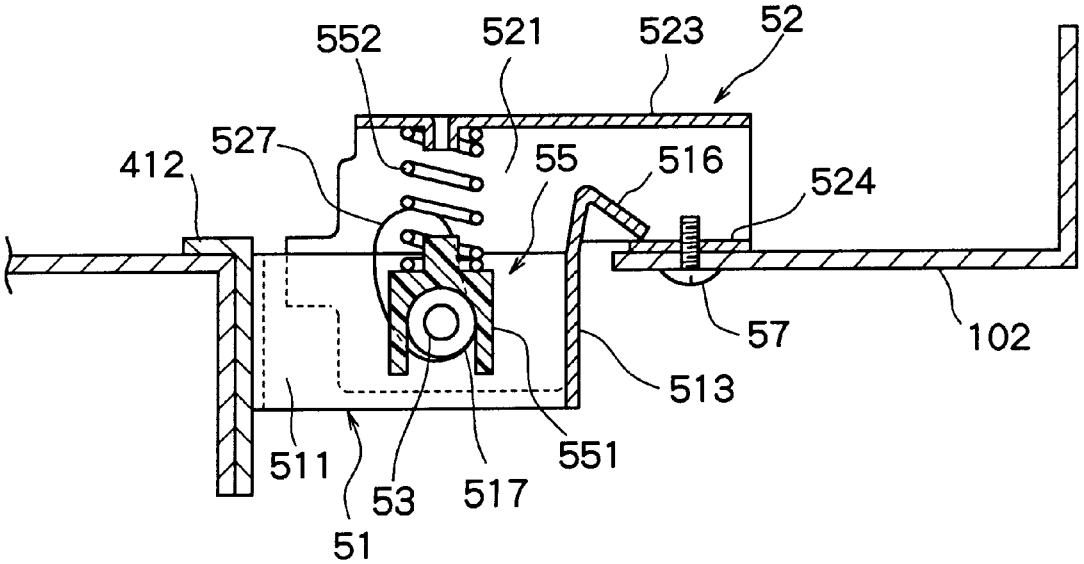
FIG. 6 is a sectional view of the first support means shown in FIG. 5.
Figure 8:
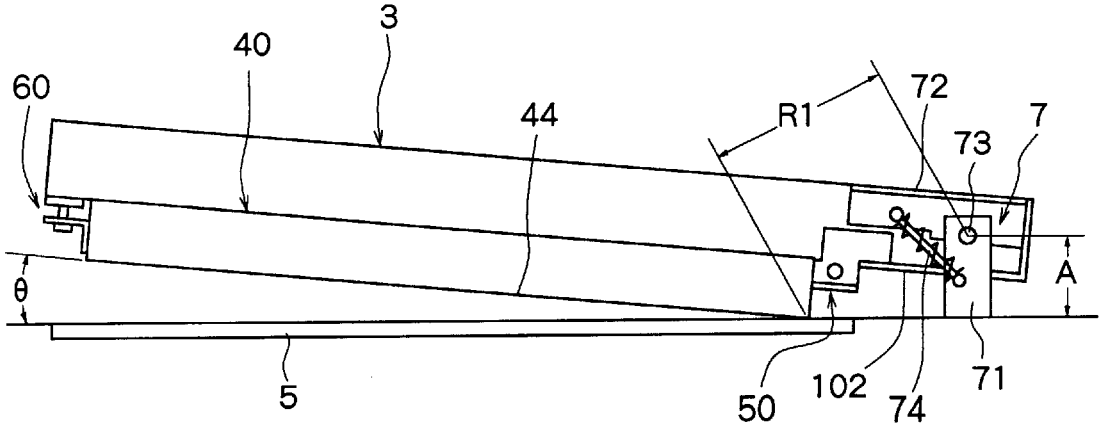
FIG. 8 is a view illustrating the operation for bringing the automatic document conveyer shown in FIG. 1 to a closed position.

Next, described below with reference to FIGS. 5, 6 and 8 is the motion of the conveyer belt mechanism 40 at the time of bringing the automatic document conveyer 3 from the open position to the closed position.

FIG. 8 illustrates a state where the automatic document conveyer 3 is moved from the open position toward the closed position and an end of the conveyer belt 44 of the conveyer belt mechanism 40 on the side of the hinge mechanism 7 (right end in FIG. 8) is brought into contact with the transparent plate 5. When the automatic document conveyer 3 in the state of FIG. 8 is turned on the hinge pin 73 in the counterclockwise direction, the end of the conveyer belt mechanism 40 on the side of the hinge mechanism 7 (right end in FIG. 8) is pushed up with respect to the rear support base plate 102. The support pins 53 of the first support member 51 mounted on the rear plate 412 of the support frame 41 of the conveyer belt mechanism 40 move upward along the guide holes 527 and 527 formed in the side walls 521 and 522 of the second support member 52 secured to the rear support base plate 102 against the resilient force of the coil springs 552. Since the guide holes 527 and 527 are inclined forward from the lower side to the upper side, i.e., inclined toward the side opposite to the hinge mechanism 7, the conveyer belt mechanism 40 is moved forward, i.e., toward the side opposite to the hinge mechanism 7 (toward the left in FIG. 8). At this time, the conveyer belt mechanism 40 is supported by the second support means 60 so as to be allowed to move in the back and forth direction (in the up-and-down direction in FIG. 4 or in the right-and-left direction in FIG. 7) with respect to the front support base plate 12 along the elongated hole 612*a* and is, therefore, allowed to move toward the front side of the conveyer belt mechanism 40, i.e., toward the side opposite to the hinge mechanism 7 (toward the left in FIG. 8). Therefore, though the hinge pin 73 which is a hinge fulcrum of the hinge mechanism 7 that turnably supports the automatic document conveyer 3 locates at a position higher than the upper surface of the transparent plate 5, the position at which the conveyer belt mechanism 40 comes into contact with the transparent plate 5 does not undergo the displacement as the end of the conveyer belt 44 of the conveyer belt mechanism 40 on the side of the hinge mechanism 7 moves from the state of FIG. 8 where it is in contact with the transparent plate 5 toward the closing position. When the automatic document conveyer 3 is turned toward the open position and the conveyer belt 44 of the conveyer belt mechanism 40 separates away from the transparent plate 5, the support pins 53 are moved to the lower ends of the guide holes 527 and 527 due to the resilient force of the coil springs 552.

When the end of the conveyer belt mechanism 40 on the side of the hinge mechanism 7 moves to the closing position from the state of FIG. 8 where it is in contact with the transparent plate 5, the predetermined amount for moving the conveyer belt mechanism 40 forward, i.e., toward the side opposite to the hinge mechanism 7 (leftward in FIG. 8) is found from the following formula, i.e., the shifting amount (S) required for the guide holes 527 and 527 in the back-and-forth direction (in the right-and-left direction in FIG. 5) is found from the following formula, $$S=2\cdot R1\cdot\sin\theta/2\cdot\cos\{[90°-\theta/2]-[90°-\cos^{-1}(A/R1)]\}$$

where A is a distance from the upper surface of the transparent plate 5 to the hinge pin 73; θ is an angle (contact angle) of when the end of the conveyer belt 44 of the conveyer belt mechanism 40 on the side of the hinge mechanism 7 comes in contact with the transparent plate 5; and R1 is a distance from the hinge pin 73 to the lower end of the conveyer belt 44 of the conveyer belt mechanism 40 on the side of the hinge mechanism 7.

By setting the shifting amount (S) as described above, the displacement of the position at which the conveyer belt 44 comes in contact with the transparent plate 5 can be decreased to be substantially zero at the time when the automatic document conveyer 3 is brought to the closed position. Therefore, the document is prevented from being deviated even when the document is set by hand on the transparent plate 5.

Next, another embodiment of the second support means 60 for supporting the support frame 41 of the conveyer belt mechanism 40 on the front support base plate 12 will be described with reference to FIGS. 9 and 10. The same members as those of the above-mentioned embodiment are denoted by the same reference numerals but their description is not repeated.

Figure 9:
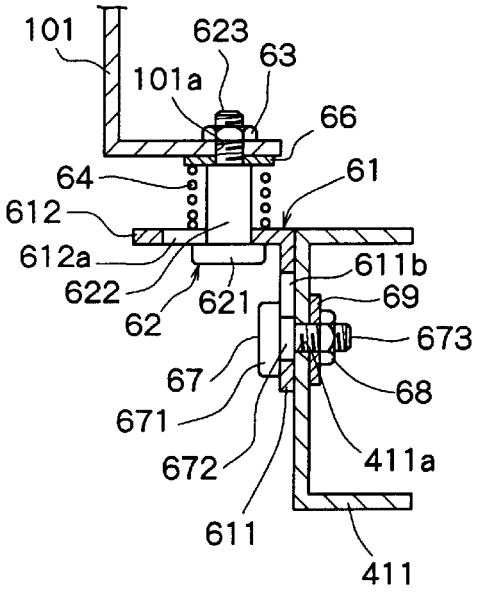
FIG. 9 is a sectional view illustrating the second support means according to another embodiment for supporting the conveyer belt mechanism shown in FIG. 4 on the moving frame.
Figure 10:
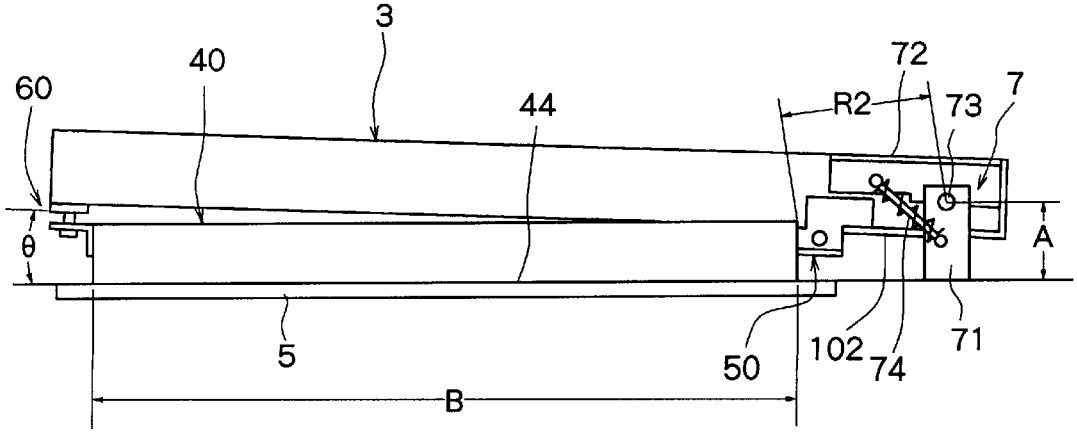
FIG. 10 is a view illustrating the operation for bringing the automatic document conveyer equipped with the second support means shown in FIG. 9 to the closed position.

In the second support means 60 shown in FIGS. 9 and 10, the mounting hole 611*b* formed in the mounting portion 611 of the mounting plate 61 is elongated in the up-and-down direction. A mounting bolt 67 which is a stepped bolt is inserted in the mounting hole 611*b* which is an elongated hole from the front side (left side in FIG. 9), and is inserted through the hole 411*a* formed in the front plate 411 constituting the support frame 41 of the conveyer belt mechanism 40. A nut is fitted to the bolt via a washer 69 that is sandwiched therebetween, to support the mounting plate 61 in such a manner to allow to move in the up-and-down direction. That is, the mounting bolt 67 has a head portion 671, a shaft portion 672 and a threaded portion 673, and the length of the shaft portion 672 is slightly longer than the thickness of the mounting portion 611 of the mounting plate 61. Despite the nut 68 is tightened, therefore, the mounting portion 611 is not secured to the front plate 411, i.e., the mounting plate 61 and the support frame 41 are allowed to move relative to each other along the mounting hole 611*b*. Like in the above-mentioned embodiment, the support portion 612 of the mounting plate 61 is supported by the front support base plate 101 so as to allow to move in the up-and-down direction (in the up-and-down direction in FIG. 9) along the shaft portion 622 of the mounting bolt 62. Therefore, the support frame 41 supported by the mounting plate 61, i.e., the front side of the conveyer belt mechanism 40 is supported by the front support base plate 101 with an amount of suspension (H) equal to the sum of the length in the up-and-down direction of the mounting hole 611*b* and the length of the shaft portion 622 of the mounting bolt 62. By setting the amount of suspension (H) to a predetermined value, the conveyer belt 44 of the conveyer belt mechanism 40 can be brought into contact with the transparent plate 5 in parallel therewith. The amount of suspension (H) required for bringing the conveyer belt into contact with the transparent plate 5 in parallel therewith is found from the following equation, $$H=B\cdot\tan\theta$$

where θ is an angle (contact angle) of when the conveyer belt 44 of the conveyer belt mechanism 40 comes in contact with the transparent plate 5, and B is the width of the conveyer belt 44 of the conveyer belt mechanism 40.

By setting the amount of suspension (H) as described above, it is allowed to bring the conveyer belt 44 of the conveyer belt mechanism 40 into contact with the transparent plate 5 in parallel therewith at the time when the automatic document conveyer 3 is to be brought to the closed position. Even when the document is set by hand on the transparent plate 5, the document is more reliably prevented from being deviated. In the illustrated embodiment, the amount of suspension (H) is shared by the mounting hole 611*b* having an elongated shape formed in the mounting portion 611 of the mounting plate 61 and by the shaft portion of the mounting bolt 62 inserted through the support portion 612, and, hence, protrusion of the mounting portion 611 or the mounting bolt 62 of the mounting plate 61 can be decreased to a small degree.

When the conveyer belt 44 of the conveyer belt mechanism 40 moves to the closed position from the state of FIG. 10 where it is in contact with the transparent plate 5, the required shifting amount (S) in the back-and-forth direction (in the right-and-left direction in FIG. 5) is found from the following formula, $$S=2\cdot R2\cdot\sin\theta/2\cdot\cos\{[90°-\theta/2]-[90°-\cos^{-1}((A-T)/R2)]\}$$

where A is a distance from the upper surface of the transparent plate 5 to the hinge pin 73; θ is an angle (contact angle) of when the conveyer belt 44 of the conveyer belt mechanism 40 comes in contact with the transparent plate 5; R2 is a distance from the hinge pin 73 to the upper end of the conveyer belt 44 of the conveyer belt mechanism 40 on the side of the hinge mechanism 7; and T is a distance from the upper surface of the conveyer belt 44 of the upper side to the lower surface of the conveyer belt 44 of the lower side.

Being constituted as described above, the automatic document conveyer of the present invention exhibits actions and effects as described below.

That is, when the moving frame is turned toward the closing position, the conveyer belt mechanism is moved by a predetermined amount toward the side opposite to the hinge mechanism while the end of the conveyer belt on the side of the hinge mechanism reaches to the closing position after having come in contact with the transparent plate. Therefore, despite the hinge fulcrum of the hinge mechanism which turnably supports the automatic document conveyer locates at a position higher than the upper surface of the transparent plate, the position at which the conveyer belt mechanism comes into contact with the transparent plate does not undergo the displacement irrespective of the motion of the end of the conveyer belt on the side of the hinge mechanism from the state where it is in contact with the transparent plate toward the closing position. When the document is set by hand on the transparent plate, therefore, the document is prevented from being deviated. Even in the copiers of the type in which the document is set to a document instruction plate on the side of the hinge mechanism (rear side), therefore, the document is prevented from being deflected or from floating. Besides, the hinge fulcrum of the hinge mechanism can be freely set.

What we claim is:

1. An automatic document conveyer comprising a moving frame arranged to move between a closed position where it covers a transparent plate arranged on the upper surface of a machine housing and an open position where it permits the transparent plate to be exposed, and a conveyer belt mechanism which conveys the document when said moving frame is brought to the closed position, said moving frame being turnably mounted on said machine housing via a hinge mechanism; wherein said conveyer belt mechanism includes a support frame, a drive roller and a driven roller arranged apart from each other in said support frame in parallel in the direction of conveying the document, and a conveyer belt wrapped round said drive roller and said driven roller, said conveyer belt mechanism being supported on said moving frame by a first support means that supports said support frame on the side of said hinge mechanism and by a second support means that supports said support frame at an end on the side opposite to said hinge mechanism;

said first support means moves said conveyer belt mechanism by a predetermined amount toward the side opposite to said hinge mechanism while the end of said conveyer belt on the side of said hinge mechanism reaches to said closed position after having come in contact with said transparent plate, at the time when said moving frame is turned toward said closed position; and said second support means permits the motion of said conveyer belt mechanism.

2. An automatic document conveyer according to claim 1, wherein said first support means includes first support members mounted on said support frame and having pin-insertion holes, second support members mounted on said moving frame and having guide holes, and support pins arranged by being inserted in the pin-insertion holes of said first support members and in the guide holes in said second support members, said guide holes having a shape elongated in the up-and-down direction and being inclined toward the side opposite to the hinge mechanism from the lower side toward the upper side.

3. An automatic document conveyer according to claim 2, wherein a pushing means is disposed between said support pin and said second support member to push said support pin toward the lower end of said guide hole.

4. An automatic document conveyer according to claim 3, wherein said pushing means comprises a pushing member fitted to said support pin, and a spring member disposed between said pushing member and said second support member.

5. An automatic document conveyer according to claim 1, wherein said second support means supports said support frame on said moving frame with a predetermined amount of suspension so as to allow the conveyer belt to come in contact with the transparent plate in parallel therewith when the moving frame is turned toward the closed position.

6. An automatic document conveyer according to claim 5, wherein said second support means has a mounting plate that is formed in an L-shape and has a mounting portion and a support portion, a hole elongated in the up-and-down direction is formed in said mounting portion, said mounting plate is mounted on said support frame so as to move relative thereto along said elongated hole, a hole is formed in said support portion, and said mounting plate is supported by said moving frame so as to be allowed to move along a mounting bolt that is fitted to said moving frame through said hole.

* * * * *